US007762787B2

(12) United States Patent
Kawakami et al.

(10) Patent No.: US 7,762,787 B2
(45) Date of Patent: Jul. 27, 2010

(54) ENGINE DRIVEN WORKING MACHINE

(75) Inventors: Toshiaki Kawakami, Saitama (JP); Toshinori Inagawa, Saitama (JP); Tsutomu Wakitani, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 312 days.

(21) Appl. No.: 11/060,801

(22) Filed: Feb. 18, 2005

(65) Prior Publication Data

US 2005/0191183 A1 Sep. 1, 2005

(30) Foreign Application Priority Data

Feb. 26, 2004 (JP) ..... 2004-052050

(51) Int. Cl.
*F04B 49/02* (2006.01)
*B05B 7/02* (2006.01)

(52) U.S. Cl. ..... 417/34; 417/12; 417/374; 417/411; 239/526

(58) Field of Classification Search ..... 239/284.1, 239/533.3, 525, 526, 527, 528; 417/12, 13, 417/16, 34, 374, 411, 313
See application file for complete search history.

(56) References Cited

U.S. PATENT DOCUMENTS 4,238,073 A * 12/1980 Liska ..... 239/127
4,743,430 A * 5/1988 Spielholz ..... 422/133
4,967,960 A * 11/1990 Futrell ..... 239/148
5,186,142 A * 2/1993 Brunelli et al. ..... 123/339.16
5,529,460 A * 6/1996 Eihusen et al. ..... 417/20

(Continued)

FOREIGN PATENT DOCUMENTS

JP 05-38132 6/1993

(Continued)

OTHER PUBLICATIONS engine. (n. d.). The American Heritage® Dictionary of the English Language, Fourth Edition. Retrieved Apr. 24, 2008, from Dictionary.com website: http://dictionary.reference.com/browse/engine.*

(Continued)

*Primary Examiner*—Devon C Kramer
*Assistant Examiner*—Leonard J Weinstein
(74) *Attorney, Agent, or Firm*—Westerman, Hattori, Daniels & Adrian, LLP

(57) ABSTRACT

In an engine drive washing machine, a discharge switch 10 is provided in a jet gun 5. When the switch 10 is turned off, an engine 1 is stopped. When the switch 10 is turned on, the engine 1 is started up to drive a pump 2. When an outlet pressure of the pump 2 is not lower than a predetermined value, a water-discharge valve in the gun 5 is opened to cause the water to be discharged. When the switch 10 is not turned off for a long time, the engine 1 is stopped. When an operator takes up the gun 5 to start the operation, the engine 1 is started up. The engine-drive type of washing machine is provided with a battery 13 for a starter motor, and the battery 13 is charged by a generator function of a starter-motor generator 3 during the operation of the engine 1.

7 Claims, 3 Drawing Sheets

U.S. PATENT DOCUMENTS

| | | | | |
|---|---|---|---|---|
| 5,848,877 | A * | 12/1998 | Dill et al. | 417/44.2 |
| 6,068,447 | A * | 5/2000 | Foege | 417/12 |
| 6,313,543 | B1 * | 11/2001 | Frank | 290/1 A |
| 6,648,603 | B2 * | 11/2003 | Dexter et al. | 417/34 |
| 6,666,022 | B1 * | 12/2003 | Yoshimatsu et al. | 60/413 |
| 6,761,135 | B1 * | 7/2004 | Becktold | 122/396 |
| 7,161,253 | B2 * | 1/2007 | Sodemann et al. | 290/1 A |

FOREIGN PATENT DOCUMENTS

| | | | |
|---|---|---|---|
| JP | 05-38132 | B | 6/1993 |
| JP | 06-41673 | | 11/1994 |
| JP | 2002-153096 | A | 5/2002 |
| JP | 2002-300798 | A | 10/2002 |
| JP | 2003-307142 | A | 10/2003 |

OTHER PUBLICATIONS

Wikipedia, Throttle, http://en.wikipedia.org/wiki/Throttle (optional description here) (as of Dec. 22, 2009, 22:58 GMT).*

Office Action issued in Japanese Appln. No. 2004-052050, dated Oct. 15, 2008.

* cited by examiner

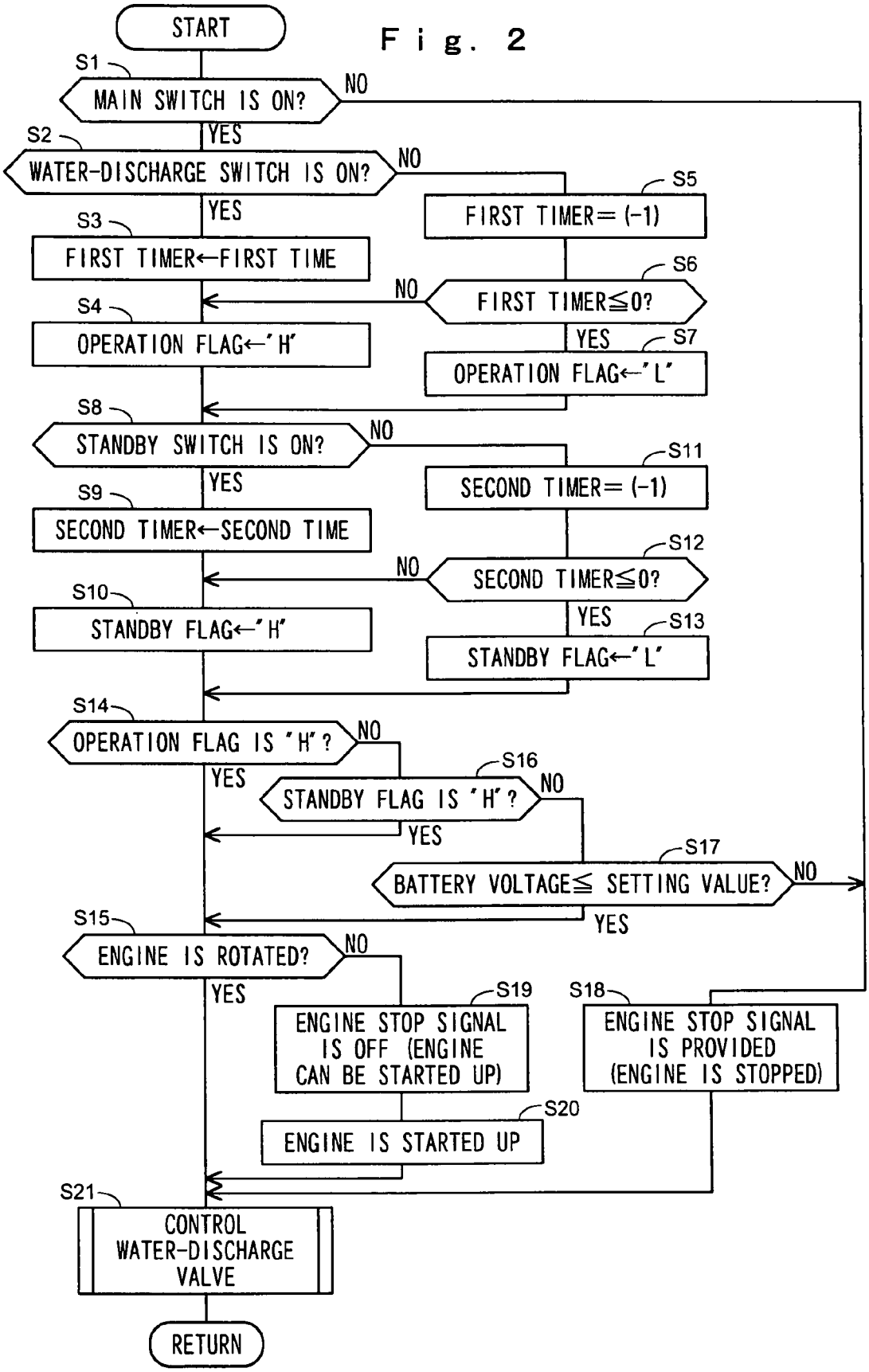
Fig. 2
START
S1
MAIN SWITCH IS ON?
NO
YES
S2
WATER-DISCHARGE SWITCH IS ON?
NO
YES
S3
FIRST TIMER←FIRST TIME
S4
OPERATION FLAG←'H'
S5
FIRST TIMER=(-1)
S6
FIRST TIMER≦0?
NO
YES
S7
OPERATION FLAG←'L'
S8
STANDBY SWITCH IS ON?
NO
YES
S9
SECOND TIMER←SECOND TIME
S10
STANDBY FLAG←'H'
S11
SECOND TIMER=(-1)
S12
SECOND TIMER≦0?
NO
YES
S13
STANDBY FLAG←'L'
S14
OPERATION FLAG IS 'H'?
NO
YES
S16
STANDBY FLAG IS 'H'?
NO
YES
S17
BATTERY VOLTAGE≦ SETTING VALUE?
NO
YES
S15
ENGINE IS ROTATED?
NO
YES
S19
ENGINE STOP SIGNAL IS OFF (ENGINE CAN BE STARTED UP)
S18
ENGINE STOP SIGNAL IS PROVIDED (ENGINE IS STOPPED)
S20
ENGINE IS STARTED UP
S21
CONTROL WATER-DISCHARGE VALVE
RETURN

ENGINE DRIVEN WORKING MACHINE

BACKGROUND OF THE INVENTION

1. Field of the Invention

The present invention relates to an engine driven type of working machine, which stops its operation while standby state to eliminate wasteful running.

2. Description of the Related Art

An engine driven type of high-pressure washing machine which can discharge washing water with an engine driven pump is well known. For example, Japanese Patent Publication of examined patent application No. H5-38132 and Japanese patent Publication of examined Utility Model application No. H6-41673 disclose a control device in the engine driven type of high-pressure washing machine which can automatically decrease engine revolution speed while stopping wash operation. The control device saves fuel, reduces exhaust gas, and decreases running noise.

In the control device described in the above Patent Publications, because the engine is operated at the low number of revolutions while being in a standby state, the fuel economy can be improved to a certain level, however it is not sufficient. The high-pressure pump is still running even while the washing operation is pausing, so power supply is needed to return excess water or unloaded water back to a water tank, that causes waste of energy.

In order to improve effects such as a fuel economy, it is thought stopping the engine during a pause in the washing operation. However, an operator is forced to operate to turn off a switch provided for start and stop washing and to perform stop operation of the engine besides. Therefore, it is desired to save energy efficiently and to save operator's needless operation.

SUMMARY OF THE INVENTION

In view of the foregoing, an object of the invention is to provide an engine driven type of working machine such as the washing machine which can save the fuel, reduce the exhaust gas, and decrease the running noise while facilitating the start and the stop of the washing operation.

The present invention described in claim 1 is that an engine driven type of working machine which has a pump driven by an engine and a discharge device for discharging fluid ejected from the pump, the engine driven type of working machine comprising, a starter-motor generator which is coupled to the engine, the starter-motor generator acting as a starter motor driven by an electricity supplied with a battery during startup of the engine, the starter-motor generator acting as a generator for charging the battery during operation of the engine, a unit which detects an operation standby state and a operation state of the discharge device, and a control unit which stops the engine in the operation standby state and starts up the engine in the operation state to drive the pump.

The present invention described in claim 2 is that an engine driven type of working machine according to claim 1, further comprising an operation switch which drives the discharge device, wherein the control unit is configured to start up the engine responsive to turn-on of the operation switch.

The present invention described in claim 3 is that an engine drive type of working machine according to claim 2, wherein when a pressure on an outlet side of the pump is increased, a valve provided in the discharge device is configured to be open.

The present invention described in claim 4 is that an engine drive type of working machine according to claim 2, wherein when a time interval when the operation switch is continuously turned off over a predetermined value, the engine is configured to be stopped.

The present invention described in claim 5 is that an engine drive type of working machine according to claim 1, wherein when the discharge device becomes a fluid-discharge state, the starter-motor generator act as the starter motor, and the detection signal is generated when the engine is stopped.

The present invention described in claim 6, wherein when the battery voltage is become lower than the predetermined value, the starter-motor generator act as the generator.

According to the first aspect of the invention, the engine can be stopped in the standby state in which the fluid discharge operation by the discharge device is paused, and the engine can be started up when the fluid discharge operation is about to be performed. Therefore, the needless standby running is decreased and the effects such as a fuel economy, the decrease in running noise, and the exhaust gas reduction can be improved. The battery which supplies electric power to the starter-motor is charged by the engine driven generator, so that the invention can sufficiently respond to the case in which the start operation and the stop operation are frequently performed.

According to the second aspect of the invention, the engine is started up responsive to the turn-on of the operation switch of the discharge device. Therefore, the engine driven type of working machine of the invention can become immediately the operable state from the standby state.

According to the third aspect of the invention, when the engine driven type of working machine detects that the pump outlet pressure is increased to the predetermined value, the valve of the discharge device is opened. Therefore, the fluid can immediately be discharged with the opening of the valve, when the engine is already rotated. In the case where the engine is stopped, by starting the engine, the pressure reaches the sufficient value, then the fluid can be discharged without delay.

According to the fourth aspect of the invention, when the engine driven type of working machine detects that the working switch is turned off for longer time than a predetermined time and decides that the stop duration of the operation is long, the engine can be stopped. In this case, the time when the engine driven type of working machine decides whether the engine is stopped is appropriately set according to an operation mode. Therefore, the waste that the operation is paused while the engine is running can be eliminated without decreasing operation efficiency.

According to the fifth aspect of the invention, when the operator takes up the handheld discharge device, the standby switch can detect that the engine driven type of working machine is in the operation standby state, and the engine which is stopped can be started up responsive to the detection of the standby switch. Therefore, the engine driven type of working machine becomes the state in which the fluid can be discharged until the operator takes up the discharge device by hand and transfers to the next movement, so that the fluid discharge operation can substantially be started without waiting time when the operator starts the operation.

According to the sixth aspect of the invention, the sufficient battery voltage can always be secured.

Thus, according to the invention, the decrease in running noise of the engine, the used fuel economy, and the exhaust gas reduction can substantially be realized while the operation efficiency can be improved, in the washing operation which is performed by discharging the fluid such as the washing water.

BRIEF DESCRIPTION OF THE DRAWINGS

FIG. 2 is a main flowchart for operating a control unit of the engine driven type of high-pressure washing machine.

DETAILED DESCRIPTION OF THE PREFERRED EMBODIMENTS

Figure 1:
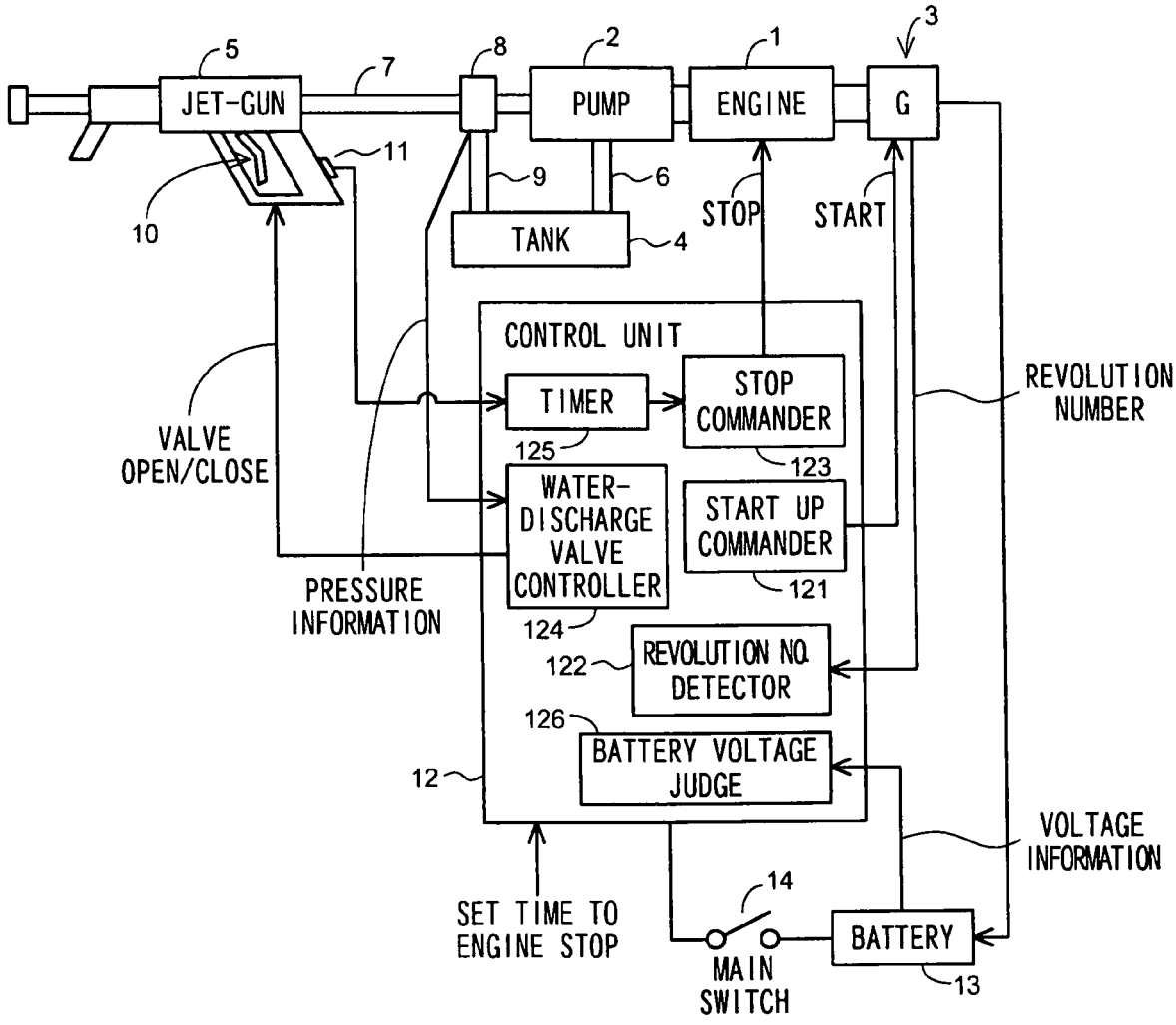
FIG. 1 is a block diagram showing a system configuration of an engine driven type of high-pressure washing machine according to an embodiment of the invention.

Referring now to the accompanying drawings, a preferred embodiment of the invention will be described in detail. FIG. 1 is a block diagram showing a system configuration of an engine driven type of high-pressure washing machine according to the embodiment of the invention. An engine 1 is an air-cooled four-cycle engine. One end of an output shaft is coupled to a pump 2, and the other end is coupled to a starter-motor generator 3 which is used as both a starter motor and a generator. The pump 2 pumps up the washing water stored in a tank 4 to supply the washing water to a washing-water jet gun 5. A water inlet of the pump 2 is coupled to the tank 4 through a water-supply pipe 6, and an outlet of the pump 2 is coupled to the jet gun 5 through a high-pressure hose 7. An unloader valve 8 is provided on the high-pressure hose 7. The unloader valve 8 includes a return pipe 9 and a pressure sensor (not shown). The return pipe 9 extends to the tank 4 to return the excess water to the tank 4, and the pressure sensor detects hydraulic pressure on the outlet side of the pump 2.

A water-discharge switch 10 is provided in the jet gun 5. When the operator starts water-jet operation, the water-discharge switch 10 is turned on and an on signal is outputted. A standby switch 11 is provided in a holder (not shown) by which the jet gun 5 is supported or suspended while the gun 5 is not used. In this case, when the jet gun 5 is taken off from the holder, the standby switch 11 is turned on. It is also possible that the standby switch 11 is provided on the side of the jet gun 5 to keep engaging with the holder while the jet gun 5 is placed on the holder. It is also possible that the water-discharge switch 10 and the standby switch 11 are integrated, the standby switch 11 is turned on when a grip of the jet gun 5 is firmly grasped, or the water-discharge switch 10 is turned on when the grip is lightly grasped. Namely, the switches may be provided so that they can be turn on when the operator takes up the jet gun 5 or grasps the grip of jet gun 5 in order to start the water-jet operation. A water-discharge valve (not shown) is incorporated into the jet gun 5. When the water-discharge valve is opened, the high-pressure water is discharged from the jet gun 5.

A control unit 12 is provided as control means which controls the engine 1 and the starter-motor generator 3. The control unit 12 is provided with a microcomputer, and the control unit is operated by a battery 13. The battery 13 provides electric power to the control unit 12 through a main switch 14. The battery 13 also supplies power supply to start up the starter-motor generator 3, and the battery 13 is charged by output power of the starter-motor generator 3.

In the control unit 12, the microcomputer acts as a startup command unit 121, a revolving speed detection unit 122, a stop command unit 123, a water-discharge control unit 124, a timer unit 125, and a battery-voltage judging unit 126.

The startup command unit 121 provides a startup signal to the starter-motor generator 3. The revolving speed detection unit 122 detects the number of revolutions of the starter-motor generator 3. The stop command unit 123 provides the engine 1 with a stop signal. When the water-discharge switch 10 is turned on, the pressure sensor provided in the unloader valve 8 detects the pressure not lower than a predetermined value, which allows the water-discharge control unit 124 to open the water-discharge valve of the jet gun 5. The timer unit 125 determines timing for the stop of the engine. The battery-voltage judging unit 126 captures voltage information of the battery 13 to monitor a remaining level of the battery 13.

FIG. 2 is a flowchart of a main routine for operating the control unit 12. In Step S1, it is decided whether a main switch 14 is turned on or not. When the main switch 14 is turned on, the flow goes to Step S2. In Step S2, it is decided whether the water-discharge switch 10 is operated or not. When the water-discharge switch 10 is turned on, the flow goes to Step S3. In Step S3, a first time is set in a first timer of the timer unit 125. In Step S4, an operation flag is set to "H" which shows that the water-discharge switch 10 is turned on.

On the other hand, when the water-discharge switch 10 is not turned on, the flow goes to Step S5 from Step S2. In Step S5, the first timer is decremented. In Step S6, it is decided whether a value of the first timer is lower than zero or not. The value of the first timer is lower than zero in the state in which the water-discharge switch 10 is not turned on, and the value of the first timer is also lower than zero after the first time elapsed since the water-discharge switch 10 was turned on. In this case, the flow goes to Step S7 from Step S6. The flow goes to Step S4 from Step S6 until the first time elapses. In Step S7, the operation flag is set to "L".

When the operation flag is set to "H" or "L", the flow goes to Step S8. In Step S8, it is decided whether the standby switch 11 is turned on or not, i.e. it is decided whether the operator takes up the jet gun 5 to start the operation or not. Namely, it is decided whether the jet gun 5 is in the operation standby state or not. When the standby switch 11 is turned on, the flow goes to Step S9. In Step S9, a second time is set in a second timer of the timer unit 125. In Step S10, a standby flag is set to "H" which shows that the standby switch 11 is turned on.

On the other hand, when the standby switch 11 is not turned on, the flow goes to Step S11 from Step S8. In Step S11, the second timer is decremented. In Step S12, it is decided whether the value of the second timer is lower than zero or not. The value of the second timer is lower than zero in the state in which the water-discharge switch is not turned on, and the value of the second timer is also lower than zero after the second time elapsed since the standby switch 11 was turned on. In this case, the flow goes to Step S13 from Step S12. The flow goes to Step S10 from Step S12 until the second time elapses. In Step S13, the standby flag is set to "L".

When the standby flag is set to "H" or "L", the flow goes to Step S14. In Step S14, it is decided whether the operation flag is set in "H" or "L". When the operation flag is set in "H", the flow goes to Step S15. When the operation flag is set in "L", the flow goes to Step S16.

When the control unit 12 is in an initial state or the like, the flow goes to Step S17. In Step S17, it is decided whether the standby flag is set in "H" or "L". When the standby flag is set in "H", the flow goes to Step S15. When the standby flag is set in "L", the flow goes to Step S17.

When the control unit 12 is in the initial state or the like, the flow goes to Step S17. In Step S17, the battery-voltage judging unit 126 judges whether the battery voltage is lower than a setting value or not. When the battery voltage is not lower than the setting value, the flow goes to Step S18. In Step S18, the engine stop signal is provided to the engine 1. Namely, the stop command unit 123 outputs the stop signal to stop the engine 1 in the initial state. The stop command unit 123 also outputs the stop signal when the first time elapsed since the water-discharge switch 10 was turned off. Further, the stop command unit 123 also outputs the stop signal at both the time when the second time elapsed since the standby switch 11 was turned off and the time when the battery 13 is sufficiently charged.

On the contrary, the flow goes to Step S15 and it is decided whether the engine 1 is rotated or not, when the water-discharge switch 10 is turned on, or when the first time did not elapse since the water-discharge switch 10 was turned off. It is also decided whether the engine 1 is rotated, when the standby switch 11 is turned on, or when the second time did not elapse since the standby switch 11 was turned off. Further, it is decided whether the engine 1 is rotated, when the battery voltage is lower than the setting value. Whether the engine 1 is rotated or not is decided by the number of revolutions of the engine 1 detected by the revolving speed detection unit 122.

When the engine 1 is stopped, the flow goes to Step S19 from Step S15. In Step S19, the stop signal is set to an off state so that the engine 1 can be started up. In Step S20, the startup command unit 121 outputs the startup signal for starting up the engine 1.

Figure 3:
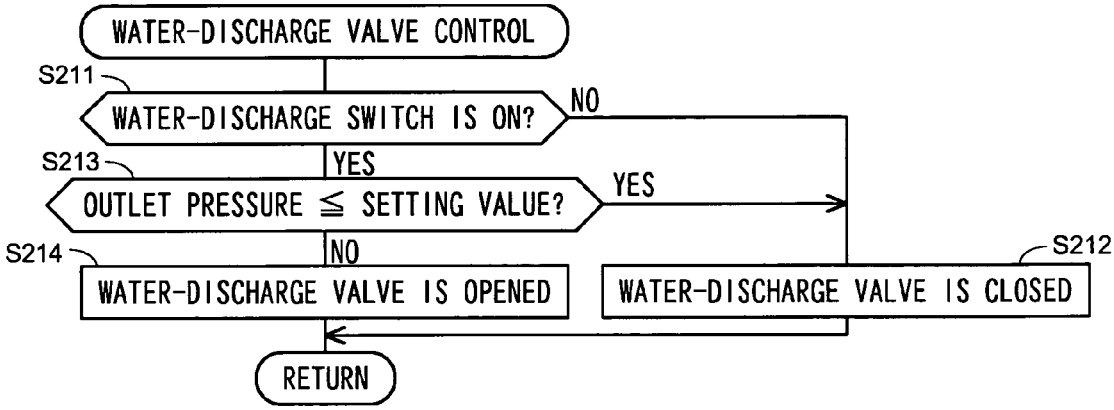
FIG. 3 is a flowchart, which is included in the main flow chart, for controlling a water-discharge valve.

When the engine 1 is rotated, the flow goes to Step S21. In Step S21, the water-discharge valve is controlled. The control of the water-discharge valve will be described below. FIG. 3 shows a flowchart for controlling the water-discharge valve. In Step S211, it is decided whether the water-discharge switch 10 is turned on or not. When the water-discharge switch 10 is not turned on, the flow goes to Step S212. In Step S212, the water-discharge valve is closed so that the water is not supplied from the pump 2 to the jet gun 5. When the water-discharge switch 10 is turned on, the flow goes to Step S213. In Step S213, it is decided whether the pressure on the outlet side of the pump 2 is lower than a predetermined value or not. When pressure is not lower than the predetermined value, the flow goes to Step S214. In Step S214, the water-discharge valve is opened so that the high-pressure water is discharged from the jet gun 5. When the discharge pressure is lower than the predetermined value, the flow goes to Step S212. In Step S212, the water-discharge valve is closed so that the water is not discharged from the jet gun 5.

Figure 4:
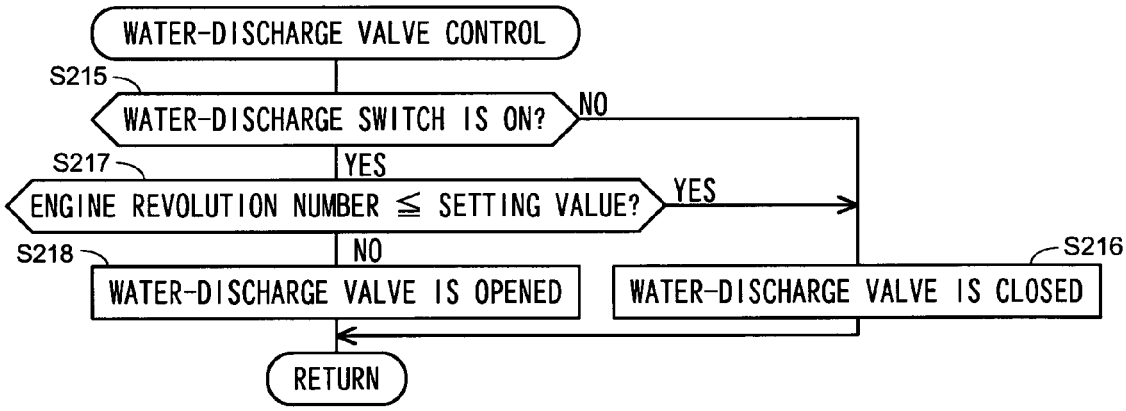
FIG. 4 is a flowchart showing the control of the water-discharge valve according to a modification of the invention.

FIG. 4 is a flowchart showing the control of the water-discharge valve according to a modification of the invention. In Step S215, it is decided whether the water-discharge switch 10 is turned on or not. When the water-discharge switch 10 is not turned on, the flow goes to Step S216. In Step S216, the water-discharge valve is closed so that the water is not discharged from the jet gun 5. When the water-discharge switch 10 is turned on, the flow goes to Step S217. In Step S217, it is decided whether the number of revolutions of the engine 1 is lower than a predetermined value or not. When the number of revolutions of the engine 1 is not lower than the predetermined value, the flow goes to Step S218. In Step S218, the water-discharge valve is opened so that the high-pressure water is discharged from the jet gun 5. When the number of revolutions of the engine 1 is lower than the predetermined value, the flow goes to Step S216. In Step S216, the water-discharge valve is closed so that the water is not discharged from the jet gun 5.

In the embodiment, the invention is applied to the engine driven type of high-pressure washing machine. However, the invention is not limited to the engine driven type of high-pressure washing machine, but the invention can widely be applied to the engine driven type of working machines which perform various operations by engine-driving the pump to discharge the water. For example, paint is stored in the tank instead of the water, and the jet gun 5 is replaced with a spray gun, which allows the invention to be applied to a painting machine. Further, the invention can be applied to a sprayer for agricultural work.

What is claimed is:

1. An engine driven type of working machine which has a pump driven by an internal combustion engine and a discharge device for discharging liquid ejected from the pump, the engine driven type of working machine comprising:

a starter-motor generator which is coupled to the internal combustion engine, the starter-motor generator acting as a starter motor driven by an electricity supplied with a battery during startup of the internal combustion engine, the starter-motor generator acting as a generator for charging the battery during operation of the internal combustion engine;

a switch configured to be actuated by an operator which generates an operation standby state and an operation state of the discharge device;

a unit which detects the operation standby state and the operation state of the discharge device; and a control unit provided with a microcomputer which stops the internal combustion engine from operating while in the standby state in which said liquid is not discharged, and starts up the internal combustion engine while in the operation state to drive the pump to eject said discharging liquid therefrom, wherein the switch is a standby switch which is configured to generate the operation standby state when the standby switch is at a position corresponding to a predetermined holding position, and to generate the operation state when the standby switch is at a position moved off the predetermined holding position, and wherein the starter-motor generator acts as the starter motor to start up the internal combustion engine responsive to the position of the standby switch.

2. An engine driven type of working machine according to claim 1, further comprising a battery-voltage decision unit which generates a detection signal when a voltage of the battery becomes lower than a predetermined value, wherein the starter-motor generator acts as the generator responsive to the detection signal of the battery-voltage decision unit.

3. An engine driven type of working machine as in any one of claims 1 and 2, wherein a water-discharge device is provided as the discharge device, and the pump is configured to eject washing water as the liquid to act as a washing machine.

4. An engine driven type of working machine which has a pump driven by an internal combustion engine and a discharge device for discharging liquid ejected from the pump, the engine driven type of working machine comprising:

a starter-motor generator which is coupled to the internal combustion engine, the starter-motor generator acting as a starter motor driven by an electricity supplied with a battery during startup of the internal combustion engine, the starter-motor generator acting as a generator for charging the battery during operation of the internal combustion engine;

an operation switch, configured to be actuated by an operator, which generates an operation standby state and an operation state of the discharge device, the operation switch being configured to generate the operation standby state when said operation switch is in a first position, and being configured to generate the operation state when said operation switch is in a second position;

a unit which detects the operation standby state and the operation state of the discharge device;

a control unit controlling said internal combustion engine and said starter-motor generator and provided with a microcomputer which stops the internal combustion engine from operating when said operation switch generates the operation standby state in which said liquid is not discharged, and which starts up the internal combustion engine when said operation switch generates the operation state to drive the pump to eject said discharging liquid therefrom, and a main switch which provides electric power to said control unit.

5. An engine driven type of working machine according to claim 4, further comprising:

a pressure detection unit which generates a detection output when a pressure on an outlet side of the pump is increased to a predetermined pressure, wherein a valve provided in a liquid discharge path of the discharge device is configured to be opened responsive to the detection output of the pressure detection unit.

6. An engine driven type of working machine according to claim 4, further comprising:

a timer unit which measures a time interval when the operation switch is continuously turned off and ends the time measurement when the time interval exceeds a predetermined value, wherein the internal combustion engine is configured to be stopped responsive to the end of the time measurement.

7. An engine driven type of working machine as in any one of claims 4, 5 and 6, wherein a water-discharge device is provided as the discharge device, and the pump is configured to eject washing water as the liquid to act as a washing machine.

* * * * *